United States Patent [19]

Ward

[11] Patent Number: 4,628,927

[45] Date of Patent: Dec. 16, 1986

[54] REVERSIBLE FACE MASK WITH REPLACEABLE AIR FILTER INSERT

[76] Inventor: Russell G. Ward, 2050 S.W. 71st Ave., Portland, Oreg. 97225

[21] Appl. No.: 837,423

[22] Filed: Mar. 7, 1986

Related U.S. Application Data

[63] Continuation-in-part of Ser. No. 555,342, Nov. 22, 1983, abandoned.

[51] Int. Cl.[4] ..... A61B 7/00

[52] U.S. Cl. ..... 128/206.17; 128/206.19

[58] Field of Search ..... 128/205.27, 205.29, 128/206.12, 206.13, 206.14, 206.15, 206.16, 206.17, 206.19, 206.25, 206.27, 206.28, 206.24, 206.21, 201.25

[56] References Cited

U.S. PATENT DOCUMENTS

| | | | |
|---|---|---|---|
| 612,295 | 10/1898 | Woodling | 128/203.29 |
| 1,292,096 | 5/1919 | Schwartz | 128/206.16 |
| 1,410,928 | 3/1922 | Knoblock | 128/206.17 |
| 1,925,764 | 9/1933 | Le Duc | 128/206.12 |
| 1,946,334 | 2/1934 | Schwartz | 128/206.16 |
| 2,070,754 | 2/1937 | Schwartz | 128/206.16 |
| 2,112,270 | 3/1938 | Cover | 128/206.17 |
| 2,201,315 | 5/1940 | Lehmberg | 128/206.16 |
| 4,300,240 | 11/1981 | Edwards | 2/206 |

FOREIGN PATENT DOCUMENTS

| | | | |
|---|---|---|---|
| 150945 | 9/1920 | United Kingdom | 128/206.19 |
| 368867 | 11/1969 | U.S.S.R. | 128/206.19 |

*Primary Examiner*—Henry J. Recla

*Attorney, Agent, or Firm*—James D. Givnan, Jr.

[57] ABSTRACT

A face mask in which an air filter insert is confined in place between mask components with a mask main member being at least partially reversible to facilitate filter insert replacement. A filter element, also of a pliable nature, fits within and conforms to the main member. A modified form of mask includes a main member having a liner portion which, during mask use, folds over and confines the filter element in place and, upon temporary unfolding of the liner portion, facilitates filter removal and replacement. Provision is made for support of a countercurrent exchange medium, such as a metallic sponge, within the mask. A modified mask includes a mesh member and a shell secured to the main mask member in a manner permitting the main member to be turned inside out. A further modified mask is of molded construction having an inwardly folded liner portion.

4 Claims, 15 Drawing Figures

REVERSIBLE FACE MASK WITH REPLACEABLE AIR FILTER INSERT

BACKGROUND OF THE INVENTION

The present application is a continuation-in-part application of my pending U.S. patent application filed Nov. 22, 1983, under Ser. No. 06/555,342 and now abandoned and having the same title.

The present invention pertains generally to face masks worn for the primary purpose of filtering out injurious matter such as pollen, dust, etc.

The prior art includes various types of face masks having an air filtering capability including masks having removable filters such as that mask disclosed in U.S. Pat. No. 2,845,926. The noted mask has a removable cellular element held in place between molded liner and outer mask members of generally triangular shape both of which define matching open areas for air passage. Removal of the filter insert from the mask incurs disassembly of the mask. Further, the semirigid molded plastic members of the mask do not conform to all facial contours resulting in gaps between face and mask, nor is a solid material next to the skin desirable from a comfort standpoint.

Other face masks primarily intended for filtration purposes include disposable masks having a cup-shaped member for placement over the nose and mouth. The cup-shaped member is of molded construction. Such disposable masks cannot be considered suitable for wear in a wide range of weather.

The present inventor has a copending patent application, filed Feb. 18, 1983 under Ser. No. 467,914 and now U.S. Pat. No. 4,520,509 which discloses a pliable outer member of a mask. U.S. Pat. Nos. 2,070,754 and 1,292,096 are of interest for they show removable air filters.

SUMMARY OF THE PRESENT INVENTION

The present invention is embodied in a face mask having the purpose of air filtration by means of a filter element removably carried within a pliable or semirigid main member.

The preset mask retains a filter in place by virtue of reversible components which may be turned inside out to permit filter replacement without necessitating mask disassembly. Accordingly, replacement of a filter element may be readily accomplished. A marginal area of the filter element is confined between pliable mask surfaces to provide not only an easily refurbished mask but one that is comfortable to wear in view of its lightweight, pliable nature.

The main member of the mask is of truncated conical shape and defines an airway or opening across which extends an open mesh member. The mesh member has an outer margin which overlies a marginal area of the main mask member and forms a bite therewith in which is removably confined the filter element. The continuous bite area of the mask member opens away from the filter when the mask is turned inside out to facilitate filter removal and replacement.

A second embodiment of the mask has a main body which has a folded portion reversible to an inside out configuration whereat a filter element is made accessible for removal and replacement. When folded and reinstalled within the main member proper, said folded portion serves as a mask liner which overlies a perimetrical or marginal area of the filter to confine same.

A further modified form of mask is also of truncated conical shape having a main member to which is secured an expanse of mesh. The mesh also overlies the marginal area of a filter to hold same in place. Upon the mask main member being turned inside out, the filter edge is exposed for removal using the fingertips. A shell overlies the main member.

A still further modified form of mask utilizes a main member of folded construction which has a rearward portion which may be folded inwardly to become a liner and overlie the marginal area of a filter to hold same in place yet permitting convenient filter removal and replacement upon unfolding of a liner portion of the main member.

Objectives of the present mask include the provision of a mask comfortable to wear during athletic activities by reason of lightweight, pliable components with a disposable filter element confined in place by reversible components of the mask; the provision of a mask having a main member defining an air passageway across which an expanse of open mesh material extends which serves to overlie the filter element and cooperates with the mask main member to frictionally hold the filter element in place; the provision of a mask using filter inserts formed from low cost, fibrous material cut from sheet material which are shaped during installation to fully overlie the open mesh area of the mask; the provision of a mask having a main member formed from material of an elastic nature which may also be of a somewhat porous nature; the provision of a mask wherein an open mesh member may have a pocket within which countercurrent exhange material is carried; the provision of a mask wherein mask construction includes the bonding of components to one another to lessen cost of manufacture and enhance mask appearance; the provision of a mask of molded construction.

DETAILED DESCRIPTION OF THE PREFERRED EMBODIMENTS

Figures 1, 2, 3, 4, 5, 6, 7, 8:
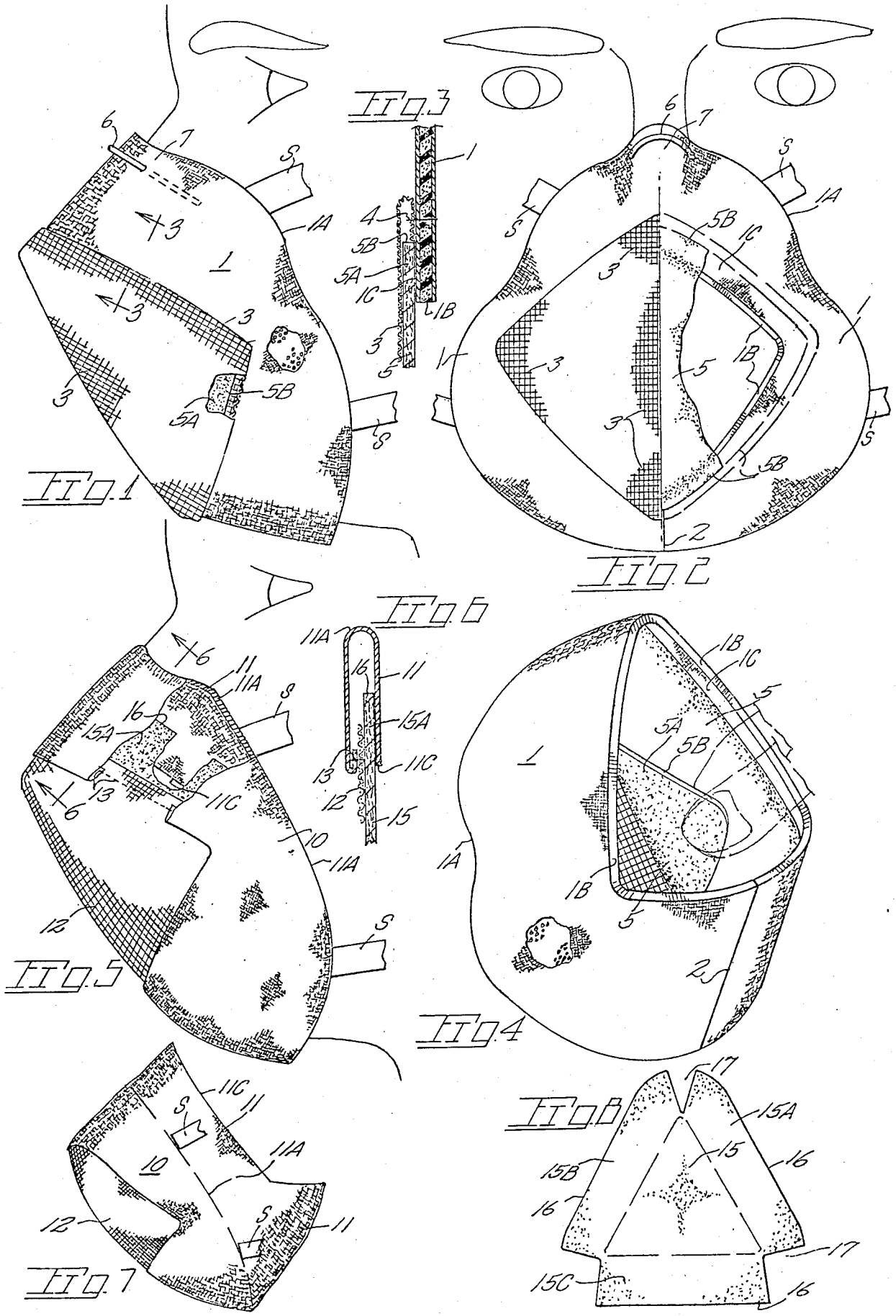
FIG. 1 is a side elevational view of the present mask.
FIG. 2 is a front elevational view of FIG. 1 with mask fragments broken away along a vertical centerline for purposes of illustration.
FIG. 3 is a vertical sectional view taken along line 3—3 of FIG. 1.
FIG. 4 is a perspective view of the mask turned inside out and a filter element partially removed therefrom.
FIG. 5 is a view similar to FIG. 1 but showing a modified form of the mask.
FIG. 6 is a vertical sectional view taken along line 6—6 of FIG. 5.
FIG. 7 is a side elevational view on a reduced scale of the mask shown in FIG. 5 with a liner portion relocated outwardly of the mask proper.
FIG. 8 is a front elevational view of a filter element for use with the present mask.

With continuing attention to the drawing wherein applied reference numerals indicate parts herinafter similarly identified, the reference numeral 1 indicates a main mask member shaped at its outer edge 1A to fit over the user's nose and jaw of the lower face in an airtight manner.

Main member 1 is of semirigid construction preferably formed of a foamed cellular material such as neoprene foam which is pliable and has a degree of elasticity along two axes. Member 1 is of conical configuration forwardly truncated along an edge 1B to define an airway opening through which air may pass. A seam at 2 may be stitched or secured by an adhesive and permits main member to be cut from sheet material. Member 1 has elastic fabric inner and outer surfaces.

A fine mesh fabric or material is indicated at 3 which overlies the main member opening with the mesh perimeter being secured to the main mask member as by a line of stitching 4. Preferably, the edges of the mesh are turned under prior to stitching. The line of stitching at 4 is offset from edge 1B of the main member to provide an overlapped frontal marginal area 1C of the main member located about the opening and bounded by edge 1B.

Straps at S may be elastic for lightly urging the mask into face contact.

A filter 5 corresponds generally to the shape of the opening in the main member but is of somewhat greater magnitude to provide a marginal portion or area 5A for the purpose of abutting the lapped area 1C as typically shown in FIG. 3. Accordingly, the main member 1 and mesh material 3 cooperate to retain filter 5 in place. The filter may be of felt or paper construction having an outer edge 5B and pliable to facilitate shaping and removal from the mask. Another suitable filter may be the multilayered filter insert disclosed in my pending U.S. patent application, Ser. No. 517,963 filed July 28, 1981 and now U.S. Pat. No. 4,520,500.

Filter removal entails the turning of the mask inside out as illustrated in FIG. 4, whereupon an edge 5B of the filter may be readily grasped with two fingers and pulled away from the adjacent edge of the main body member. A substitute filter is conveniently pressed into place with the outer edge thereof fitting between the mesh and area 1C of the main member. The mask is then reversed to return same to its normal configuration.

A shaping member at 6 is of malleable metal of U-shape to closely confine a nose bridge area 7 of the mask over the bridge of the wearer's nose. Member 6 may be externally applied or, as shown, be partially embedded with the mask nose area.

A modified mask is illustrated in FIGS. 5 and 6 and has a main member 10 formed from an expanse of continuous fabric that extends about the wearer's nose and jaw. At a fold 11A the main member is reversed or turned inwardly to provide a liner portion 11 contactible with the face. Main member 10 defines an air opening or airway in which an expanse of mesh fabric 12 is held in place by stitching at 13 or another suitable securement such as bonding. The opening defining edge of member 10 is reversed prior to stitching for appearance sake.

A filter 15 is of a shape generally corresponding to the mesh covered airway opening in main member 10 but of greater size to provide outer portions 15A, 15B and 15C bounded by a filter outer edge 16. Cutouts 17 permit filter portions to be turned inwardly to underlie and be postioned between the main body member and its inwardly folded liner 11 terminating along an edge 11C. Straps at S lightly urge the mask into face engagement and to compress, to some degree, the overlapping mask components.

The filter is removed for replacement purposes by unfolding liner 11 outwardly and rearwardly to the FIG. 7 configuration whereat an edge of the filter may be grasped and lifted out of the mask. Subsequent to filter replacement the liner is reinstalled serving to surfacially engage portions 15A, 15B and 15C of the filter.

Main member 10 may be formed from elastic fabric such as that sold under the registered trademarks SPANDEX and LYCRA which has a capability of stretching along any axis. Such material is porous to some extent but does not significantly reduce the filtering capability of the mask in view of the filter outer portions 15A, 15B and 15C underlying same. Further, the material readily conforms to facial configurations and is comfortable against the skin. The main body member 10 may be sewn at fold llA to join liner portion 11 thereto. Alternatively, main member 10 and liner portion 11 thereof may be shaped from an elastic, porous fabric. Similarly, main member 10 could be formed entirely from a screen or netting of a pliable nature with the filter element of a shape to overlie a major portion of a main member to assure adequate air filtration.

Figure 9:
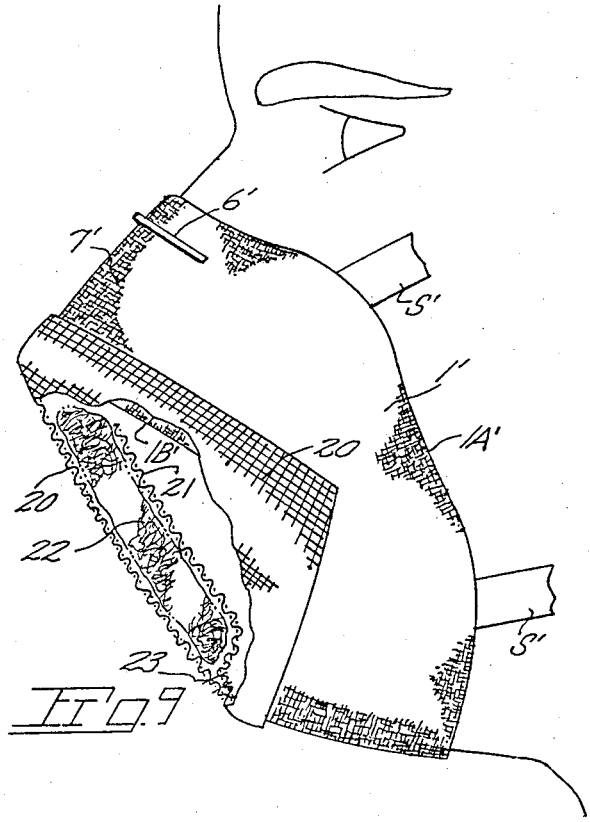
FIG. 9 is a fragmentary, side elevational view of a modified mask having a quantity of countercurrent material carried therein.

A further modified mask in FIG. 9 includes a mesh member at 20 which is formed with an interior expanse of mesh material at 21 to provide a pocket in which a quantity of countercurrent material 22 may be carried. Such material may be a metal sponge formed from intermeshed metal shavings with the capability of both warming and humidifying inhaled air by reason of being heated and moistened by exhaled air. The pocket so formed and the material carried therein are readily accessible upon the mask being turned inside out. The remaining mask components correspond to earlier described components and are identified with corresponding prime reference numerals.

The filter elements of the present mask may be of paper or fabric construction either molded or cut to a shape permitting insertion into the main body of the mask.

The mask main member may also be formed from permeable, open cell, foam material which lends itself to one piece, molded construction and obviates stitching of the main member to a desired shape. The increased permeable area of the mask is desirable by reason of a reduced pressure differential thereacross.

Figure 10:
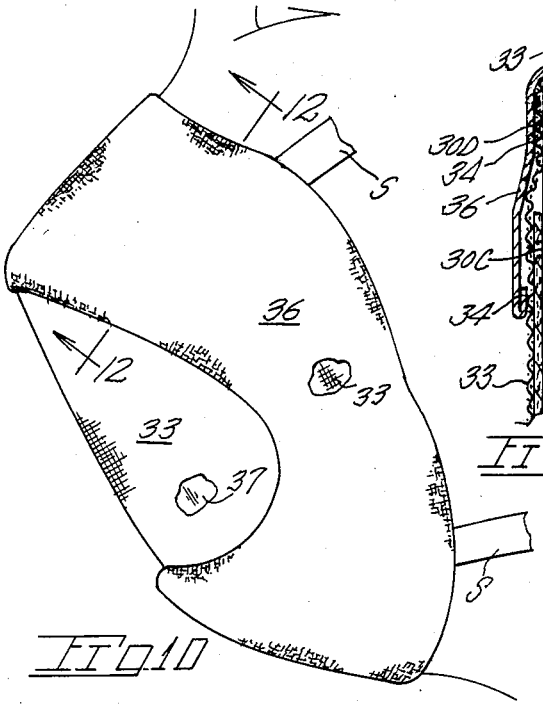
FIG. 10 is a side elevational view of a modified mask.
Figure 12:
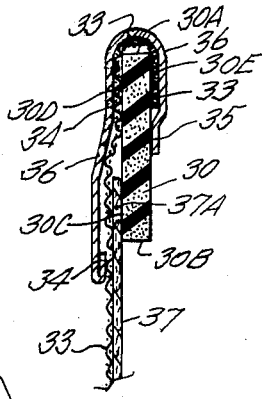
FIG. 12 is a sectional view taken along line 12—12 of FIG. 10.

In FIG. 10 a further modified form of mask has a main member 30 for placement over the user's jaw and nose in an airtight manner. Member 30 is of semirigid material such as cellular neoprene or polyurethane foam and with an outer edge at 30A. Member 30 is of truncated conical shape terminating forwardly in a continuous or inner front edge 30B. A seam is at 32 in FIG. 13.

Member 30 preferably has elastic fabric covered surfaces. A frontal marginal area is at 30C.

A mesh expanse at 33 is secured to main member 30, as by bonding with an adhesive, to a frontal portion 30D of the main member and a rearward portion 30E of same. A shell 36 covers the main member and is attached as by bonding at 34 to mesh 33 and to inner side of the main member at 35.

Straps at S are suitably secured to the main member.

Figure 13:
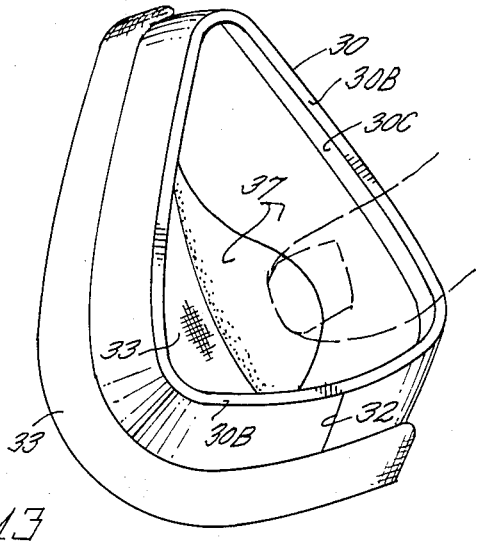
FIG. 13 is a perspective view of the modified mask of FIG. 10 turned inside out and a filter element being removed therefrom.
Figure 11:
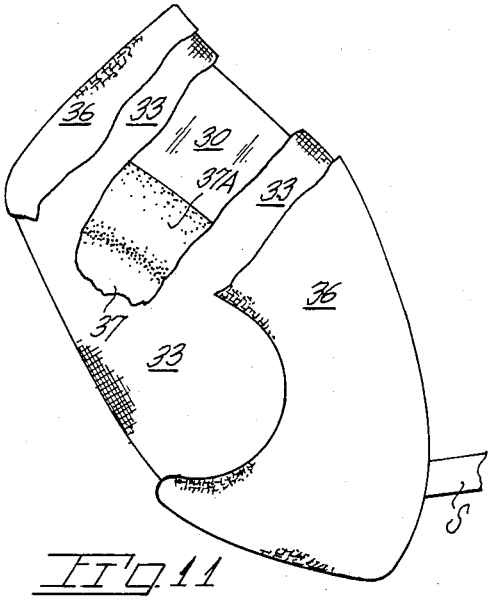
FIG. 11 is a view similar to FIG. 10 but with fragments broken away.

A disposable filter at 37 is of a pliable nature, as earlier noted, and includes a marginal portion 37A for superimposition in a detachable manner against the main member area 30C. The filter is held against the main member by mesh 33 and by the shell. Filter removal, as shown in FIG. 13, is as earlier described with the first described mask.

Figure 14:
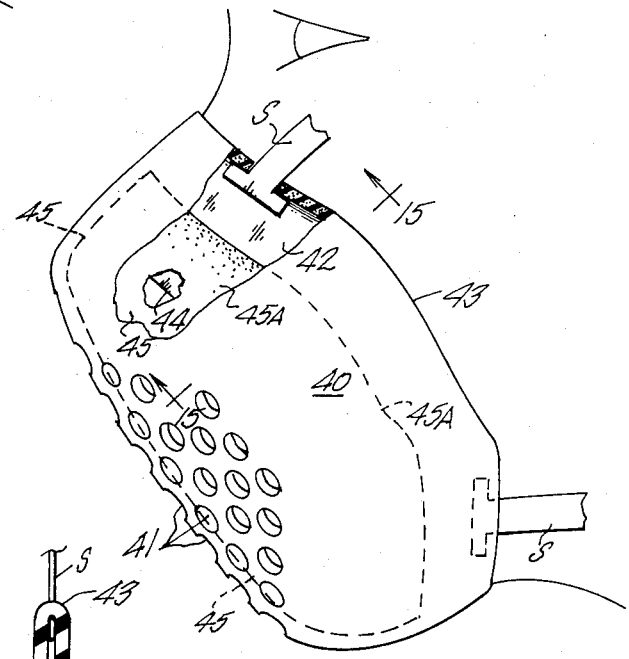
FIG. 14 is a side elevational view of still another form of mask and of molded construction with a foldable liner portion.
Figure 15:
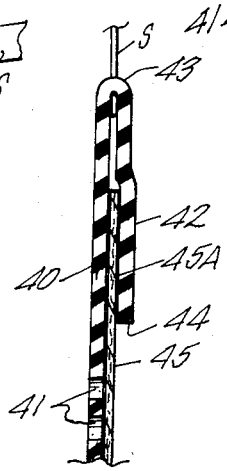
FIG. 15 is a sectional view taken along line 15—15 of FIG. 14.

In FIGS. 14 and 15 a further modified mask is of molded construction having a main member 40 of truncated conical configuration for wear over the lower face. An air opening is provided by a multitude of openings 41. The main member material may be the same semirigid material as described with the mask shown in FIG. 10. A liner portion 42 of the main member is provided by folding same inwardly along a fold 43. The liner portion 42 terminates along an edge 44. A filter element at 45 has an outer marginal portion 45A which is sandwiched between main member 40 and its liner portion 42 in a removable manner since the liner portion may be unfolded along fold 43. Head attaching straps are at S.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. An air filtering breathing mask for wear during adverse environmental conditions, said mask comprising, a main member of conical configuration and of semirigid construction which may be turned inside out to a reversed conical configuration during changing of a filter element, said mask main member having a continuous inner edge defining an opening, a frontal marginal area of the main member extending about said opening, head attachment means on said main member, a mesh member in place on said main member and overlying said frontal marginal area of the main member and extending across said opening, means joining said mesh member and said main member along a course offset from said inner edge of the main member, a filter element normally having one side overlapped by said mesh member and overlapped on its remaining side by said frontal marginal area of the main member to retain the filter element in place, and said main member upon being turned inside out having its frontal marginal area displaced away from the marginal area of the filter element to expose same to facilitate grasping of the filter element with the fingertips and subsequently permitting unobstructed insertion of a replacement filter element.

2. The breathing mask claimed in claim 1 wherein said mesh member is secured to said main member proximate said frontal marginal area of the main member.

3. The breathing mask claimed in claim 1 additionally including a shell of fabric secured to mesh member and to said main member.

4. The breathing mask claimed in claim 3 wherein said shell and said mesh member are secured to one another and to opposite sides of said main member.

* * * * *